US012011055B1

(12) United States Patent
Rowden

(10) Patent No.: US 12,011,055 B1
(45) Date of Patent: Jun. 18, 2024

(54) GRADUATION CAP DECORATION SYSTEM AND METHOD

(71) Applicant: Rhonda L. Rowden, Prosper, TX (US)

(72) Inventor: Rhonda L. Rowden, Prosper, TX (US)

( * ) Notice: Subject to any disclaimer, the term of this patent is extended or adjusted under 35 U.S.C. 154(b) by 0 days.

(21) Appl. No.: 17/990,219

(22) Filed: Nov. 18, 2022

Related U.S. Application Data

(60) Provisional application No. 63/281,006, filed on Nov. 18, 2021.

(51) Int. Cl.
*A42B 1/004* (2021.01)

(52) U.S. Cl.
CPC ..... *A42B 1/004* (2013.01)

(58) Field of Classification Search
CPC ..... A42B 1/004; A42B 1/02; A42B 1/248
USPC ..... 2/171.01
See application file for complete search history.

(56) References Cited

U.S. PATENT DOCUMENTS 4,222,125 A * 9/1980 Sewell-Wood ..... A42B 1/004 2/195.1
4,270,229 A * 6/1981 Lipschutz ..... A42C 1/00 2/195.1
5,509,144 A * 4/1996 Soergel ..... A42B 1/248 2/209.13
5,771,493 A * 6/1998 Proctor ..... A42B 1/004 2/171.1
5,896,585 A * 4/1999 Stazo ..... A42B 1/24 2/244
6,094,749 A * 8/2000 Proctor ..... A42B 1/248 2/171.1
6,279,167 B1 * 8/2001 Johnson ..... A42B 1/004 446/72
9,241,526 B2 1/2016 Goldberg
2005/0039308 A1 * 2/2005 Rogers ..... A44B 1/04 24/113 R
2007/0022514 A1 * 2/2007 Paulson ..... A42B 1/248 2/171
2007/0033705 A1 2/2007 Dickson
2012/0132355 A1 * 5/2012 Turner ..... D06P 5/005 156/277
2016/0174646 A1 6/2016 Burns
2017/0049174 A1 2/2017 Holcomb
2017/0224059 A1 * 8/2017 Groetzki ..... A41D 27/08

OTHER PUBLICATIONS

"How to Decorate a Custom Graduation Cap". Midwest Mermaid Olivia. URL="http://www.midwestmermaidolivia.com/2018/04/how-to-decorate-custom-graduation-cap.html" (Year: 2018).*

(Continued)

*Primary Examiner* — Jameson D Collier
(74) *Attorney, Agent, or Firm* — Richard Eldredge; Leavitt Eldredge Law Firm

(57) ABSTRACT

A graduation cap decoration system includes a topper having a predetermined shaped body and an opening; a circle-shaped piece configured to fit within the opening and to provide for a covering for the button of a graduation cap; and a plurality of adhesive hook and loop connectors for removably securing the topper to the graduation cap; wherein the topper and circle-shaped piece can be decorated using various techniques including heat transfer vinyl and sublimation.

5 Claims, 2 Drawing Sheets

(56) References Cited

OTHER PUBLICATIONS

"Graduation Caps". Entry by "Rozzieray" (May 3, 2016). Student Doctor Network. URL ="https://forums.studentdoctor.net/threads/graduation-caps.1195487/page-2" (picture attachment of Rozzieray entry appended as last page) (Year: 2016).*

* cited by examiner

GRADUATION CAP DECORATION SYSTEM AND METHOD

CROSS REFERENCE TO RELATED APPLICATIONS

This application claims the benefit of U.S. Provisional Application 63/281,006, filed Nov. 18, 2021, of which is hereby incorporated by reference in its entirety.

BACKGROUND

1. Field of the Invention

The present invention relates generally to graduation cap decoration systems, and more specifically, to a graduation cap decoration system and method that utilizes a graduation cap topper for decoration that is removably secured to a graduation cap, wherein the topper is heat resistant and can be decorated using mediums that require heat.

2. Description of Related Art

Graduation cap decoration systems are well known in the art and are effective means to customize a graduation cap. For example, it is common for graduates to adhere and decorate the top of their cap based on their own personal preferences. One of the problems commonly associated with these conventional systems is that graduation caps are not heat resistant and therefore the user is limited on their type of adhesives. In addition, some graduation ceremonies do not allow decorations, and accordingly, a user may desire to have a system that is removable.

Accordingly, although great strides have been made in the area of graduation cap decoration systems, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
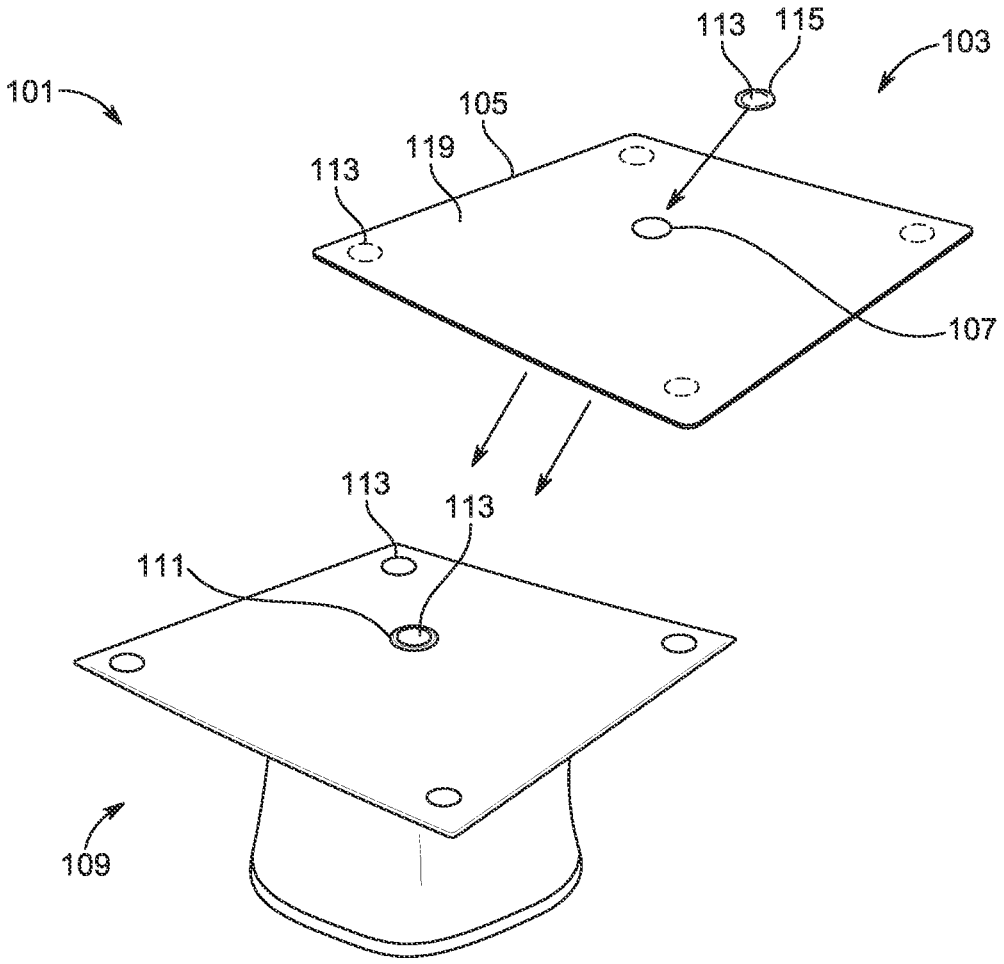
FIG. 1 depicts a schematic representation of a graduation cap decoration system in accordance with a preferred embodiment of the present application.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional graduation cap decoration systems. Specifically, the present invention provides for a system and method that utilizes a topper to allow a user the ability to remove the decorations from their cap. In addition, the topper is heat resistant, thereby providing the user with the ability to use various heat adhesives as desired. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Referring now to the drawings wherein like reference characters identify corresponding or similar elements throughout the several views, FIG. 1 depicts a schematic representation of a graduation cap decoration system 101 in accordance with a preferred embodiment of the present application.

System 101 includes a topper 103 having a predetermined shaped body 105 constructed from preferably a non-polyvinyl chloride (non-PVC) flexible, heat resistant, sublimatable material. The topper 103 also includes an opening 107 positioned in the center of the body 105. The opening 107 allows for the button 111 of a mortarboard or graduation cap 109 to pass therethrough. In the preferred embodiment, the body 105 is approximately 9-inches by 9-inches, however, slight modifications to the size may be appropriate. Also, in the preferred embodiment, the opening 107 is approximately 1-inch. In addition, while the body 105 is shown to have a generally square-shaped appearance, it is contemplated that the shape of the body 105 can vary (e.g., circular, star-shaped, heart-shaped, etc.).

System 101 also includes a circle-shaped piece 115 cut from the same material as the body 105 (i.e., non-PVC, flexible, heat resistant, sublimatable material) and thus can be decorated. The circle-shaped piece 115 provides for a covering for over the button 111 of the mortarboard 109. In the preferred embodiment, the circle: shaped piece is approximately 1-inch.

System 101 further includes a plurality of adhesive hook and loop connectors 113. The hook and loop connectors 113 are configured to adhere the topper 103 to the mortarboard 109. The hook and loop connectors 113 are placed on the bottom surface of the topper 103 and the top surface of the mortarboard 109. In addition, the hook and loop connectors 113 are placed on the top surface of the button 111 and on the bottom surface of the circle-shaped piece 115. In the preferred embodiment, the hook and loop connectors 113 are in the form of dots.

During use, the user will be able to decorate the surface 119 of the topper 103 as desired and then use the adhesive hook and loop connectors 113 to secure the topper 103 to the mortarboard 109, as shown with directional arrows. The user can then remove and reattach the topper 103 as desired, allowing for compliance with any rules such as during graduation ceremonies.

The system of the present invention allows or a user to create a custom designed graduation cap using a topper, wherein the topper is heat resistant and is able to receive various mediums, including paper, paint, heat transfer vinyl, and sublimation.

It should be appreciated that one of the unique features believed characteristic of the present application is that the topper of the present invention allows for use of heat transfer and sublimation materials.

Figure 2:
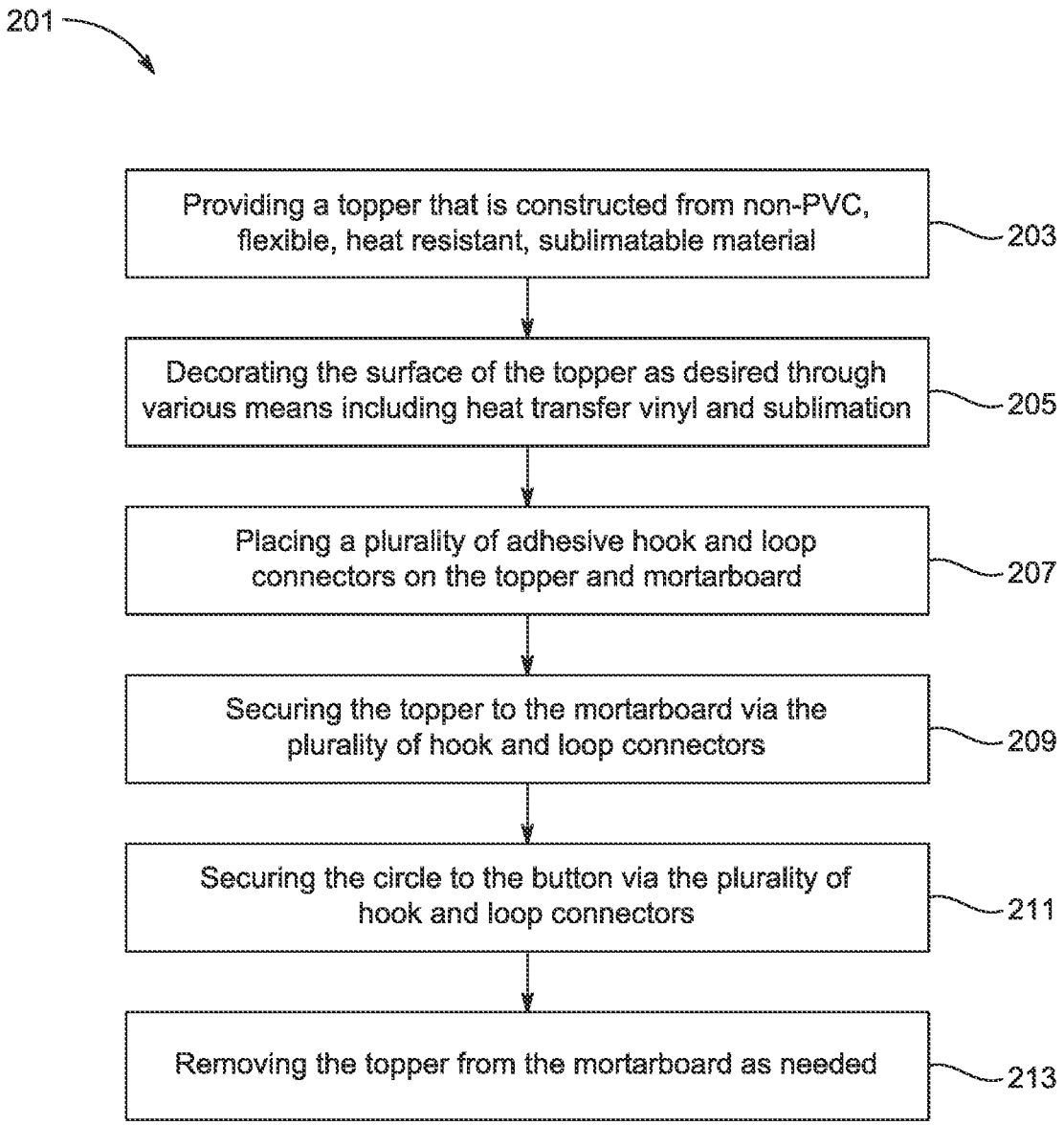
FIG. 2 is a flowchart of a method of use of the system of FIG. 1.

In FIG. 2, a flowchart 201 depicts a method of use of system 101. During use, a topper that is constructed from non-PVC, flexible, heat resistant sublimatable material is provided, as shown with box 203. Next, the surface of the topper can be decorated through various means including heat transfer vinyl and sublimation, as shown with box 205.

The user can then place a plurality of adhesive hook and loop connectors on the topper and the mortarboard, as shown with box 207. The hook and loop connectors can be placed on the bottom surface of the topper, the bottom surface of the circle-shaped piece, the top surface of a mortarboard, and the top surface of the mortarboard's button.

The user can secure the topper to the mortarboard and the circle-shaped piece to the button via the plurality of hook and loop connectors, as shown with boxes 209, 211. The user can readily remove the topper from the mortarboard as needed, as shown with box 213.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A graduation cap or mortarboard decoration system, comprising:

a topper, the topper having:

a body having a predetermined shape; and an opening positioned in a center of the body;

wherein the opening allows for a button of a graduation cap or mortarboard to pass through the opening;

a circle-shaped piece configured to fit within the opening, the circle-shaped piece capable of providing a covering for the button of the graduation cap or mortarboard, the button is configured to partially extend through the opening;

a plurality of adhesive hook and loop connectors that are configured to be secured to complementary hook and loop connectors on a top surface of the graduation cap or mortarboard and on the button and the plurality of adhesive hook and loop connectors are configured for removably securing the topper to the graduation cap or mortarboard;

wherein the plurality of adhesive hook and loop connectors are coupled to a bottom surface of the topper and to a bottom surface of the circle-shaped piece; and wherein the topper and the circle-shaped piece are capable of being decorated via heat transfer vinyl and sublimation.

2. The system of claim 1, wherein the topper and the circle-shaped piece are constructed from a non-polyvinyl chloride (non-PVC), flexible, heat resistant, sublimatable material.

3. The system of claim 1, wherein the topper has a length that is measured approximately 9 inches and a width that is measured approximately 9 inches.

4. The system of claim 1, wherein the opening is measured approximately 1-inch.

5. The system of claim 1, wherein the plurality of adhesive hook and loop connectors are in the form of dots.

* * * * *